US007895785B2

(12) United States Patent
Hail et al.

(10) Patent No.: US 7,895,785 B2
(45) Date of Patent: Mar. 1, 2011

(54) DETACHABLE TAG FOR LABELING ELECTRONICS SYSTEMS

(75) Inventors: Andrew Nathan Hail, Riverside, RI (US); Michael David Herring, Apex, NC (US); Jason Aaron Matteson, Raleigh, NC (US); Timothy Andreas Meserth, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/400,411

(22) Filed: Mar. 9, 2009

(65) Prior Publication Data

US 2010/0223827 A1 Sep. 9, 2010

(51) Int. Cl.
*G09F 3/12* (2006.01)

(52) U.S. Cl. ..... 40/668; 40/663; 361/690; 361/692

(58) Field of Classification Search ..... 40/668, 40/662, 663, 667, 661.03, 309
See application file for complete search history.

(56) References Cited

U.S. PATENT DOCUMENTS

| | | | | |
|---|---|---|---|---|
| 2,548,104 | A * | 4/1951 | Frison | 40/586 |
| 4,760,659 | A * | 8/1988 | Watabe | 40/124.02 |
| 5,067,265 | A * | 11/1991 | Harms | 40/1.5 |
| 6,144,301 | A | 11/2000 | Frieden | 340/572.8 |
| 6,477,799 | B1 | 11/2002 | Erickson et al. | 40/406 |
| 6,484,424 | B1 * | 11/2002 | Peterson | 40/1.5 |
| 6,877,264 | B2 | 4/2005 | Mautz | 40/663 |
| 7,401,430 | B2 * | 7/2008 | Lindquist et al. | 40/657 |
| 2003/0061749 | A1 | 4/2003 | Bryant | 40/591 |
| 2003/0079381 | A1 | 5/2003 | Arens et al. | 40/210 |
| 2004/0187373 | A1 | 9/2004 | Zappacosta et al. | 40/667 |

* cited by examiner

*Primary Examiner*—Lesley Morris
*Assistant Examiner*—Kristina Staley
(74) *Attorney, Agent, or Firm*—Zilka-Kotab, PC

(57) ABSTRACT

In one embodiment, a tag includes a substantially flat portion having two faces and a length and a height, wherein the length is between about 1 inch and about 2½ inches. The height is between about ⅜ inch and about 1 inch. The tag also includes at least one first member coupled to the flat portion and extending away therefrom at an angle of between about 45° and about 135° to a plane normal to a plane of the flat portion, the at least one first member being adapted for mounting in an opening of a surface of an electronics system thereby creating a removable coupling between the at least one first member and the surface of an electronics system when mounted.

19 Claims, 6 Drawing Sheets

DETACHABLE TAG FOR LABELING ELECTRONICS SYSTEMS

BACKGROUND

The present invention relates to identification tags, and more particularly, this invention relates to identification tags for electronics systems.

Many users of electronics systems and equipment would benefit from the use of asset and/or classification tags, typically adhesive labels, which could be placed on their systems for inventory and/or identification purposes. These tags could be placed on an electronics system in a readily visible area, usually on the front surface. Systems with a small form factor, such as blade servers, however, do not have sufficient front surface area to place the tags.

Therefore, many users of small form factor systems, such as blade servers, are compelled to place the tags on perforated bezel areas. This practice however interferes with the airflow available to the system and creates the possibility of component damage due to thermal design parameters being exceeded. On blade centers, there is an area provided on the chassis above the individual blade slots for a tag. This area is about 1"×⅛" in size. This space is too small to accommodate the most widely used standardized adhesive printable labels. One such standardized adhesive label measures 1⅞"×⅝". At least one expert in server design has stated that when a customer puts a label on a (IBM BLADE SERVER) perforated bezel, "it is almost guaranteed that they are having localized impact on some of the components inside the blade themselves."

Accordingly, a tag which can be used to identify individual electronics systems, including blade servers without substantially impacting airflow to the components of the electronics systems would be very beneficial to users of electronics systems.

SUMMARY

In one embodiment, a tag includes a substantially flat portion having two faces and a length and a height, wherein the length is between about 1 inch and about 2½ inches. The height is between about ⅜ inch and about 1 inch. The tag also includes at least one first member coupled to the flat portion and extending away therefrom at an angle of between about 45° and about 135° to a plane normal to a plane of the flat portion, the at least one first member being adapted for mounting in an opening of a surface of an electronics system thereby creating a removable coupling between the at least one first member and the surface of an electronics system when mounted.

In another embodiment, a tag includes a substantially flat portion having two faces and a length and a height. The length is about 2 inches and the height is about ¾ inch: The tag also includes two members coupled to the flat portion and extending away therefrom at an angle of between about 45° and about 135° to a plane of the flat portion. The angle from which the two members extend away from the flat portion is adjustable and the members are adapted for mounting in an opening of a perforated bezel of an IBM BLADE SERVER thereby creating a removable coupling between the members and the IBM BLADE SERVER when mounted. The two members are positioned near either end of the flat portion along the length and the flat portion has a recessed section between the two members, the recess extending away from a plane of the IBM BLADE SERVER. The removable coupling is effected without access to a rear side of the perforated bezel of the IBM BLADE SERVER and without use of any tools or hardware and the two members when coupled to an opening of the perforated bezel of the IBM BLADE SERVER do not block a portion of the opening of the perforated bezel of the IBM BLADE SERVER.

In another embodiment, a tag includes a substantially flat portion having two faces, wherein each face is large enough to adhere a standard 1⅞ inch by ⅝ inch adhesive label without overhang. Also, the tag includes two members coupled to the flat portion and extending away therefrom at an angle of between about 45° and about 135° to a plane of the flat portion, the two members being adapted for mounting in an opening of a second surface thereby creating a removable coupling between the two members and the second surface when mounted. The two members are positioned near either end of an edge of the flat portion and the flat portion has a recessed section between the two members, the recess extending away from a plane of the second surface. The removable coupling is effected without access to a rear side of the second surface and without use of any tools or hardware.

Any of these embodiments may be implemented in a computer system, server system, electronics system, etc., which may include a grill, bezel, and/or ventilation grating portion.

Other aspects and embodiments of the present invention will become apparent from the following detailed description, which, when taken in conjunction with the drawings, illustrate by way of example the principles of the invention.

DETAILED DESCRIPTION

Figure 1A:
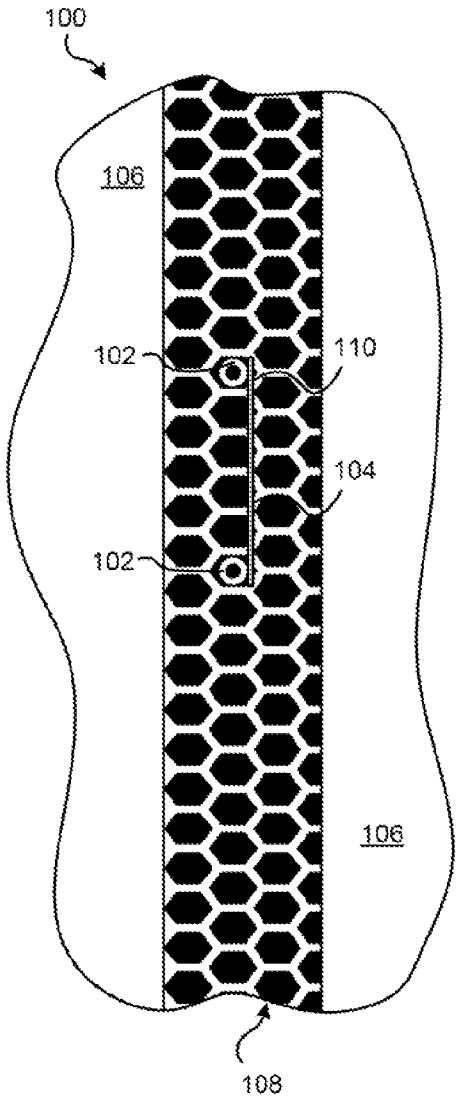
FIG. 1A is a schematic diagram of a front view of a tag coupled to an electronics system according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred embodiments of labeling systems, as well as operation and/or component parts thereof.

In one general embodiment, a tag includes a substantially flat portion having two faces and a length and a height, wherein the length is between about 1 inch and about 2½ inches, wherein the height is between about ⅜ inch and about 1 inch; and at least one first member coupled to the flat portion and extending away therefrom at an angle of between about 45° and about 135° to a plane normal to a plane of the flat portion, the at least one first member being adapted for mounting in an opening of a surface of an electronics system thereby creating a removable coupling between the at least one first member and the surface of an electronics system when mounted.

In another general embodiment, a tag comprises a substantially flat portion having two faces and a length and a height, wherein the length is about 2 inches, wherein the height is about ¾ inch; and two members coupled to the flat portion and extending away therefrom at an angle of between about 45° and about 135° to a plane of the flat portion, wherein the angle from which the two members extend away from the flat portion is adjustable, wherein the members are adapted for mounting in an opening of a perforated bezel of an IBM Blade Server thereby creating a removable coupling between the members and the IBM Blade Server when mounted, wherein the two members are positioned near either end of the flat portion along the length, wherein the flat portion has a recessed section between the two members, the recess extending away from a plane of the IBM Blade Server, wherein the removable coupling is effected without access to a rear side of the perforated bezel of the IBM Blade Server and without use of any tools or hardware, wherein the two members when coupled to an opening of the perforated bezel of the IBM Blade Server do not block a portion of the opening of the perforated bezel of the IBM Blade Server.

In another general embodiment, a tag comprises a substantially flat portion having two faces, wherein each face is large enough to adhere a standard 1⅞ inch by ⅝ inch adhesive label without overhang; and two members coupled to the flat portion and extending away therefrom at an angle of between about 45° and about 135° to a plane of the flat portion, the two members being adapted for mounting in an opening of a second surface thereby creating a removable coupling between the two members and the second surface when mounted, wherein the two members are positioned near either end of an edge of the flat portion, wherein the flat portion has a recessed section between the two members, the recess extending away from a plane of the second surface, wherein the removable coupling is effected without access to a rear side of the second surface and without use of any tools or hardware.

In some preferred embodiments, a clip-on plate may be provided for customer labeling that fits IBM blade server perforations. The plate may accommodate up to two standard 1⅞"×⅝" labels, one on either side of the flat portion of the plate. The plate preferably may present negligible disruption of airflow to the system. The plate may be used across all IBM systems that have similar perforated areas, along with any other electronics system that includes similarly sized and spaced perforations. In addition, other clip-on plates may be provided which have adjustable attachment points so as to fit even more electronics equipment, including servers from other manufacturers, such as HEWLETT-PACKARD, DELL, etc. With system form factors continually decreasing in size, a solution for customer asset tagging which does not restrict airflow to crucial system components is a welcome addition to customer site server rooms.

Figure 1B:
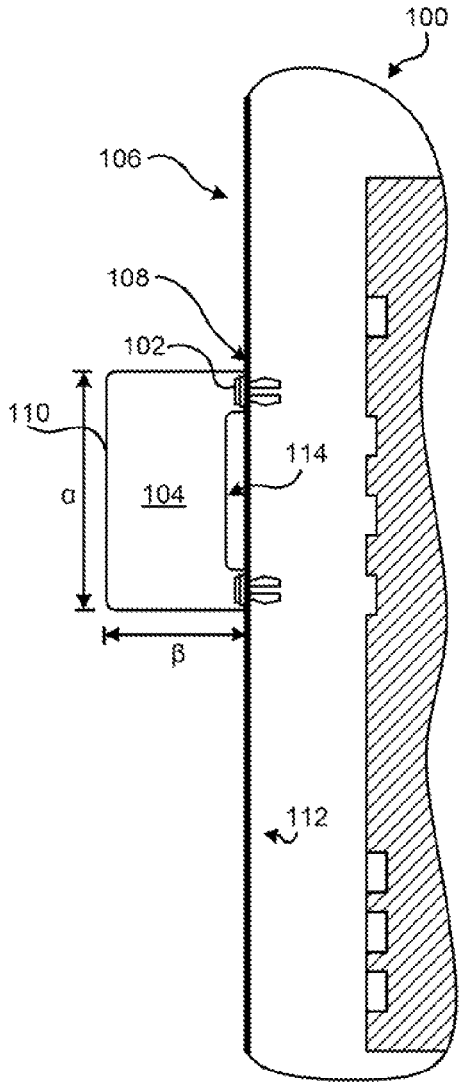
FIG. 1B is a schematic diagram of a side view of a tag coupled to an electronics system according to one embodiment.

FIGS. 1A and 1B illustrate a tag 110 coupled to a surface 106 of an electronics system 100. FIG. 1A shows the tag when the surface of the electronics system is viewed straight on, while FIG. 1B shows the tag when the surface of the electronics system is viewed from the side.

In FIG. 1A, a tag 110 is shown comprised of a substantially flat portion 104 and two members 102 which are adapted for mounting in an opening 108 of a surface 106 of an electronics system 100 thereby creating a removable coupling between the two members 102 and the surface 106 of the electronics system 100 when mounted. Of course, in some embodiments, only one member 102 may be adapted for mounting in an opening 108 of a surface 106 of an electronics system 100. In some more embodiments, more than one member 102 may be included in the tag 110, such as four members, three members, etc. In these embodiments, one or more of the members may be adapted for mounting in an opening of an electronics system.

As shown in FIG. 1B, the substantially flat portion 104 of the tag 110 has a length $\alpha$ and a height $\beta$. In some embodiments, the length $\alpha$ may be between about 1 inch and about 2½ inches, more preferably about 2 inches. In some embodiments, the height $\beta$ may be between about ⅜ inch and about 1 inch, more preferably about ¾ inch.

In some embodiments, the length $\alpha$ and the height $\beta$ may be large enough so that a standard 1⅞ inch by ⅝ inch adhesive label may be adhered to each face of the flat portion 104 without overhang.

As shown in FIGS. 1A and 1B, the members 102 are coupled to the flat portion 104 and extend away therefrom at an angle of about 90° to a plane normal to a plane of the flat portion 104. Of course, the members 102 may extend away from the flat portion 104 at any angle between about 45° and about 135° to a plane normal to a plane of the flat portion 104.

In some embodiments, as shown in FIG. 1B, the tag 110 may further comprise two members 102, wherein the flat portion 104 has a recessed section 114 between the two members 102, the recess 114 extending away from a plane of the surface 106 of an electronics system 100. Each of these members 102 may be adapted for mounting in an opening 108 of an electronics system 100. In some other embodiments, less than all of these members may be adapted for mounting in an opening 108 of an electronics system 100.

In some more embodiments, the tag 110 may further comprise at least one member 102 coupled to the flat portion 104 and extending away therefrom at an angle of between about 45° and about 135° to a plane normal to a plane of the flat portion 104, wherein the at least one member 102 does not create a removable coupling when mounted between the at least one member 102 and the surface 106 of an electronics system 100. For example, the tag 110 may include one member which is adapted to detachably couple to the surface 106 of an electronics system 100, while another member 102 is not so adapted. Some examples of members which may or may not be adapted include pegs, pins, posts, and any other members as would be known to one of skill in the relevant art.

In some approaches, the surface 106 of an electronics system 100 may be a perforated or ventilated portion of a computer server enclosure. In further approaches, the surface 106 of an electronics system 100 is a perforated bezel of an IBM Blade Server.

In some preferred embodiments, the tag 110 may be mountable to a surface 106 of an electronics system 100 without access to a rear side 112 of the surface 106 of the electronics system 100.

According to some embodiments, the tag 110 may be removable from a surface 106 of an electronics system 100 without access to a rear side 112 of the surface 106 of the electronics system 100.

In more embodiments, the tag 110 may be mountable to a surface 106 of an electronics system 100 without use of any tools or hardware. Further, the tag 110 may be removable from a surface 106 of an electronics system 100 without use of any tools or hardware.

Also, according to some embodiments, one or more members 102 when mounted in an opening of a surface 106 of an electronics system 100, may not protrude substantially beyond a rear side 112 of the surface 106 of an electronics system 100.

In some embodiments, a member 102 may include a magnetic portion for effecting the removable coupling between the member 102 and the surface 106 of an electronics system 100. The magnetic portion may be part of the portion which contacts the surface 106 of the electronics system 100, or may be another portion.

In some embodiments, the at least one member 102 coupled to the flat portion 104 may extend away therefrom at an adjustable angle of between about 45° and about 135° to a plane normal to a plane of the flat portion 104. This allows a user of the tag 110 to select which angle of protrusion is best suited for the installation.

Additionally, according to some preferred embodiments, a member 102, when coupled to an opening 108 of a surface 106 of an electronics system 100 may not block a portion of the opening 108 of the surface 106 of the electronics system 100. This can be seen in each of the embodiments shown in FIGS. 3B, 3D and 3F by the opening 202 which is still present even after insertion of the member 300, 310, 320 into the hole 202 in the surface 204.

Figure 2A:
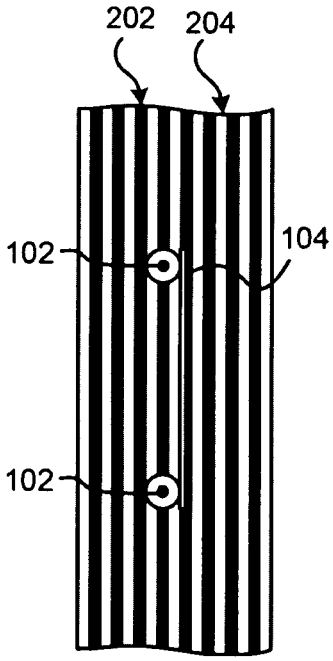
FIGS. 2A-2C illustrate surfaces of electronics systems according to some embodiments.
Figure 2B:
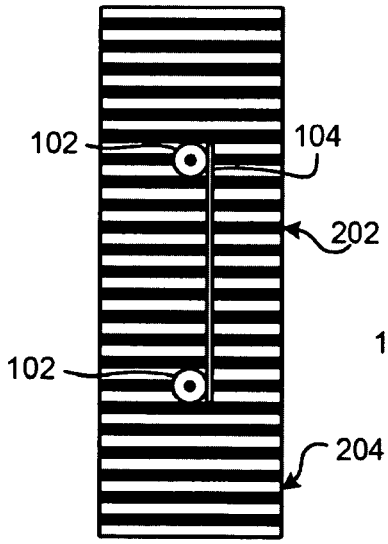
Figure 2C:
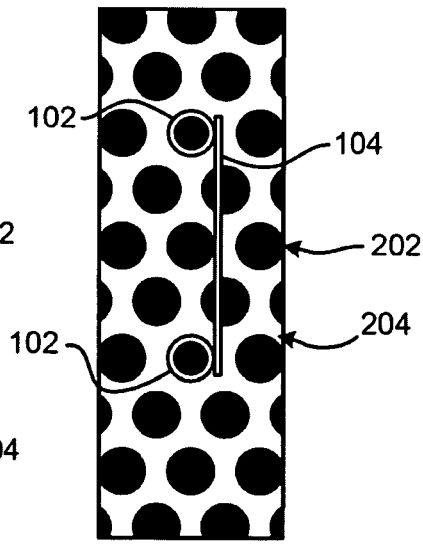

Now referring to FIGS. 2A-2C, some additional openings 202 in a surface 204 of an electronics system are shown. In FIG. 2A, each member 102 is coupled to an opening 202 oriented in vertical slots on a surface 204 of an electronics system. Of course, one or more members may be coupled, while the remaining members do not effect a coupling with the surface.

In FIG. 2B, each member 102 is coupled to an opening 202 oriented in horizontal slots on a surface 204 of an electronics system. Of course, one or more members may be coupled, while the remaining members do not effect a coupling with the surface. Similarly, slots oriented in any direction may be used in conjunction with this invention.

In addition, as shown in FIG. 2C, smaller or larger openings 202 in a surface 204 may be used with which to effect a coupling between a member 102 and the opening 202. Other opening sizes and shapes may also be used, such as squares, rectangles, hexagons, waffle patterns, etc.

With reference to FIGS. 3A-3F, some embodiments of members for coupling to an opening of a surface are shown which may be used in conjunction with any embodiment included herein.

Figure 3A:
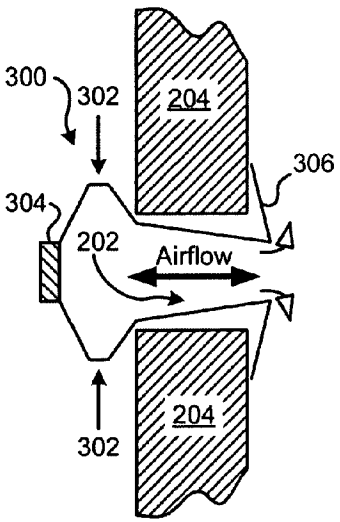
FIG. 3A shows a schematic diagram of a side view of a member for coupling a tag to a surface of an electronics system according to one embodiment.

With reference to FIG. 3A, in some embodiments, a member 300 may comprise a compressible portion 306 for effecting the removable coupling between the member 300 and the surface 204. The member 300 may include a portion 304 for supporting the compressible portion 306. The arrows 302 indicate a direction with which pressure may be applied to effect removal of the member 300 from the surface 204 without access to the rear of the surface. The white headed arrows indicate the direction in which pressure is exerted on the hole 202 and possibly the surface 204 to hold the member 300 in place during use.

Figure 3B:
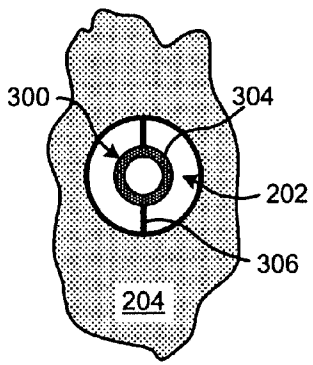
FIG. 3B shows a schematic diagram of a front view of a member for coupling a tag to a surface of an electronics system according to one embodiment.

As can be seen in FIG. 3B, which is a side view of the member 300 coupled to the surface 204, this member 300 allows substantial airflow through the hole 202 when coupled, with very little inhibition of airflow due to the thin size of the wire.

Figure 3C:
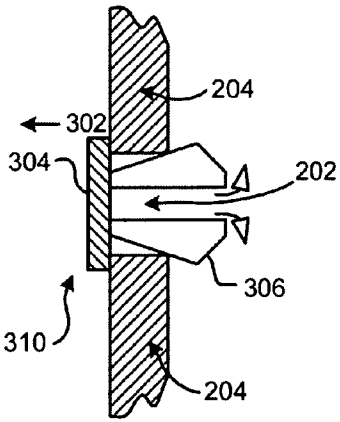
FIG. 3C shows a schematic diagram of a side view of a member for coupling a tag to a surface of an electronics system according to one embodiment.

With reference to FIG. 3C, in some embodiments, a member 310 may further comprise a spring post for effecting the removable coupling between the member 310 and the surface 204. The member 310 may include a portion 304 for supporting the compressible portion 306. The arrow 302 indicates a direction with which pressure may be applied to effect removal of the member 310 from the surface 204 without access to the rear of the surface. The spring post may simply be pulled away from the surface 204 as the spring portions 306 are shaped to retract when the supporting portion 304 is pulled. The white headed arrows indicate the direction in which pressure is exerted on the hole 202 and possibly the surface 204 to hold the member 310 in place during use.

Figure 3D:
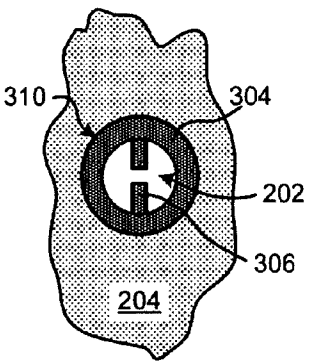
FIG. 3D shows a schematic diagram of a front view of a member for coupling a tag to a surface of an electronics system according to one embodiment.

As can be seen in FIG. 3D, which is a side view of the member 310 coupled to the surface 204, this member 310 allows some airflow through the hole 202 when coupled, with some of the hole 202 covered, but some of the hole 202 open for airflow into and out of the electronics system.

Figure 3E:
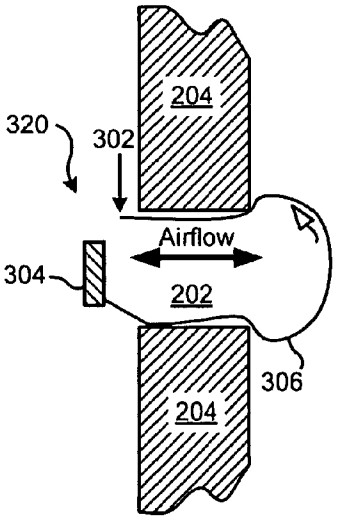
FIG. 3E shows a schematic diagram of a side view of a member for coupling a tag to a surface of an electronics system according to one embodiment.

With reference to FIG. 3E, in some embodiments, a member 320 may further comprise a bent wire or ribbon 306 for effecting the removable coupling between the member 320 and the surface 204. The member 320 may include a portion 304 for supporting the compressible portion 306. The arrow 302 indicates a direction with which pressure may be applied to effect removal of the member 320 from the surface 204 without access to the rear of the surface. The white headed arrows indicate the direction in which pressure is exerted on the hole 202 and possibly the surface 204 to hold the member 300 in place during use.

Figure 3F:
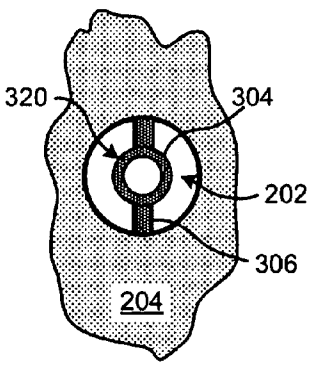
FIG. 3F shows a schematic diagram of a front view of a member for coupling a tag to a surface of an electronics system according to one embodiment.

As can be seen in FIG. 3F, which is a side view of the member 320 coupled to the surface 204, this member 320 allows almost uninhibited airflow through the hole 202 when coupled. The airflow is only restricted by the size of the ribbon or wire 306 used. The less the airflow into and out of the hole is inhibited, the better the electronics system will be able to cool itself, an improvement on some prior art methods of coupling a tag to a grill of an electronics system.

Figure 4B:
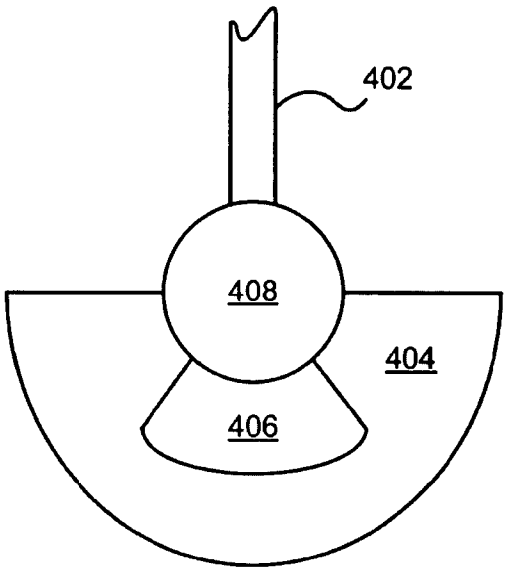
FIG. 4B shows an enlarged view taken from line 4B in FIG. 4A according to one embodiment.
Figure 4A:
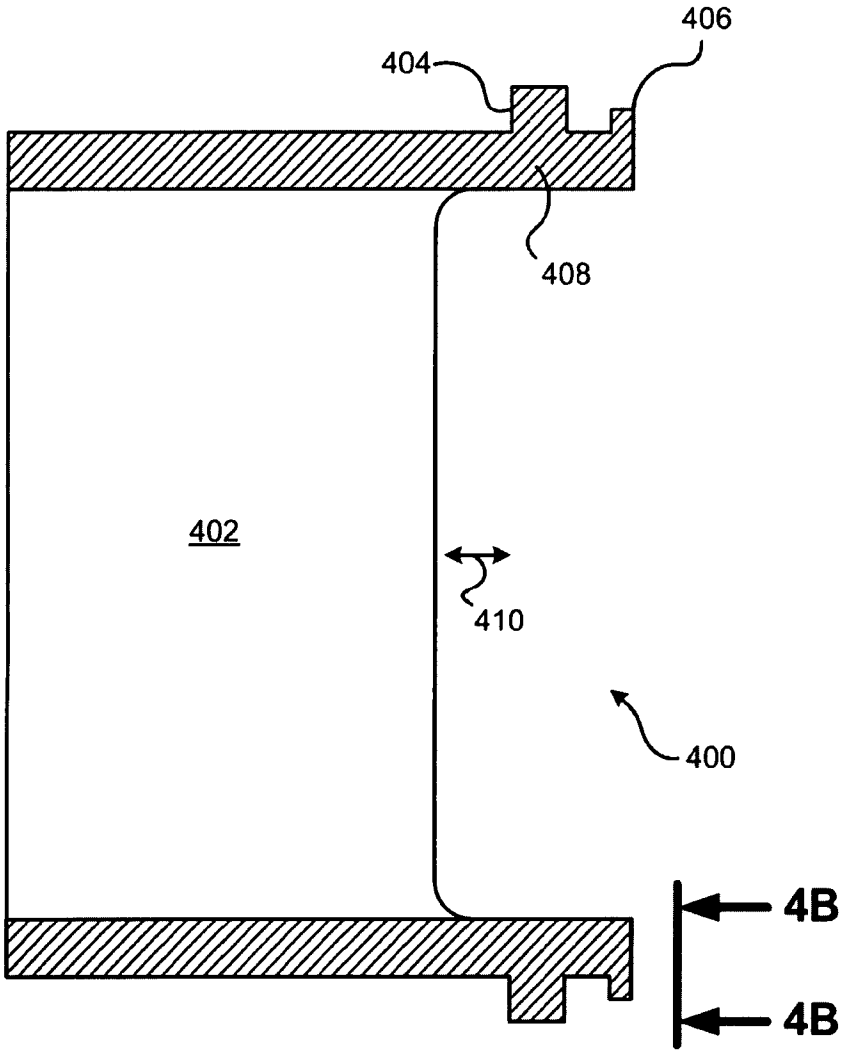
FIG. 4A shows a side view of a removable tag according to one embodiment.

Now referring to FIGS. 4A-4F, a removable tag 400 may be described according to another embodiment. Referring to FIG. 4A, the tag 400 may include a surface 402 for placement of a label. Also, the tag 400 may include one or more legs 408, each leg 408 including a stop flange 404 and a grip flange 406. Also, there may be an air gap 410 for enabling the flow of air to and from any equipment behind the surface which the tag 400 is mounted to.

Now referring to FIG. 4B, an enlarged view of the end of one of the legs 408 is shown according to one embodiment, taken from line 4B in FIG. 4A. The grip flange 406 is smaller than the stop flange 404 in this embodiment, for easier insertion of the grip flange 406 into a hole of a surface.

Figure 4D:
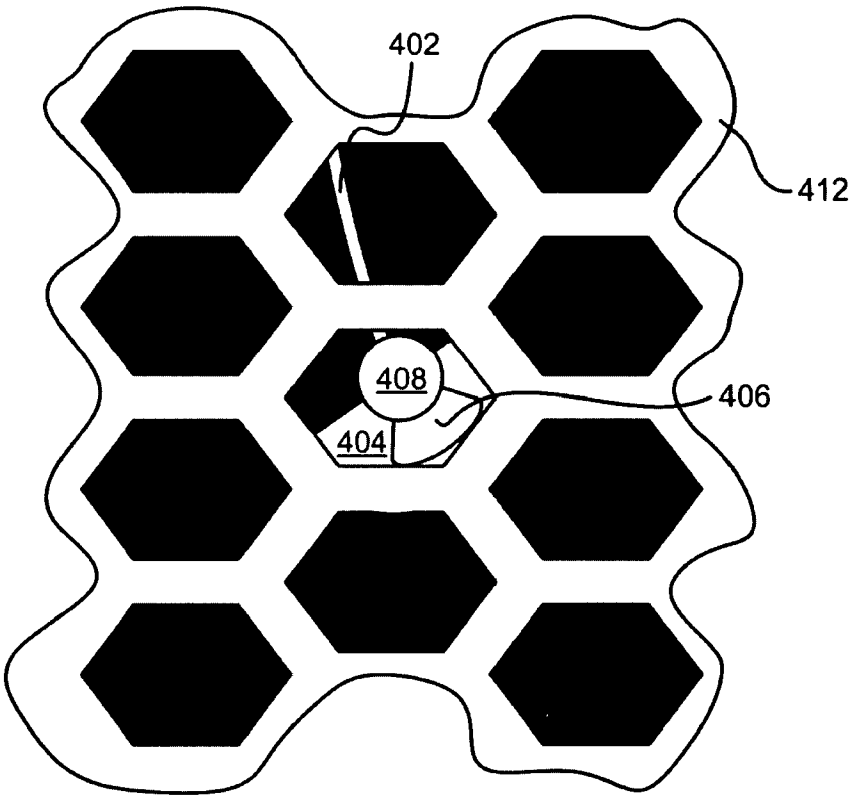
FIG. 4D shows an enlarged view from an opposite side of a coupling device according to one embodiment.
Figure 4C:
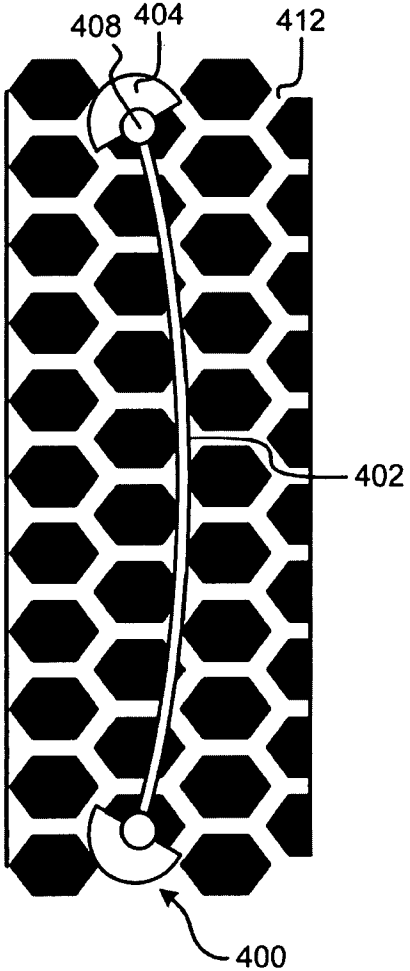
FIG. 4C is a schematic diagram of a front view of a flexed tag for coupling to an electronics system according to one embodiment.

Now referring to FIG. 4C, a tag 400 is shown according to one embodiment being mounted to a surface 412. The tag 400 may be flexible, such that it can be flexed to allow the grip flanges 406 on either leg 408 to insert into holes on the surface 412. As shown in FIG. 4D, a view from the opposite side of the surface 412, the grip flange 406 is small enough to fit through the hole in the surface 412 according to one embodiment. The stop flange 404, however, is too large to fit into the hole of the surface 412, thus causing the tag 400 to stop when inserted into the hole.

Figure 4F:
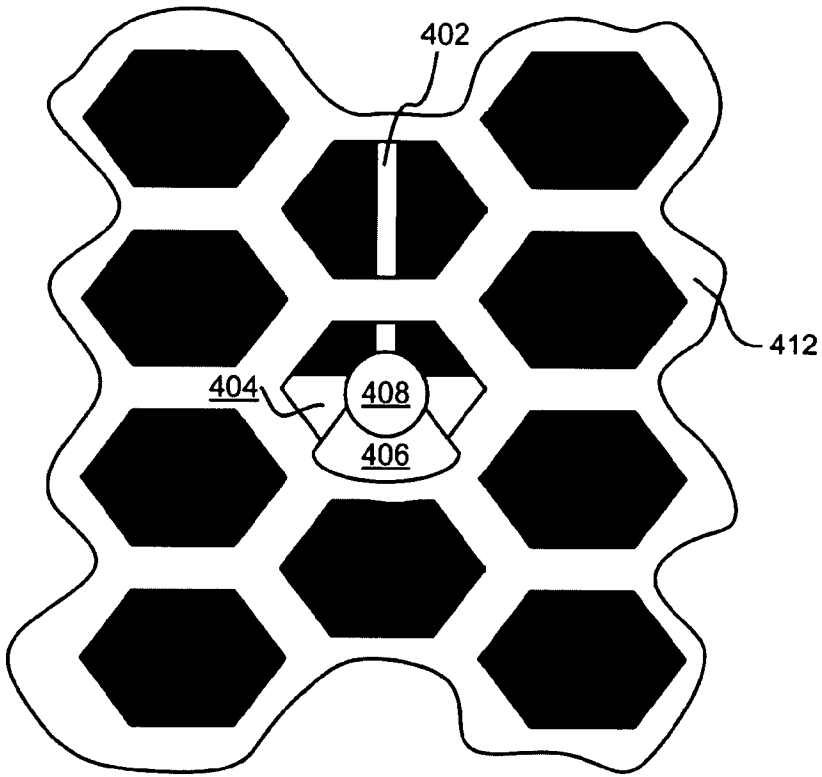
FIG. 4F shows an enlarged view from an opposite side of a coupling device according to one embodiment.
Figure 4E:
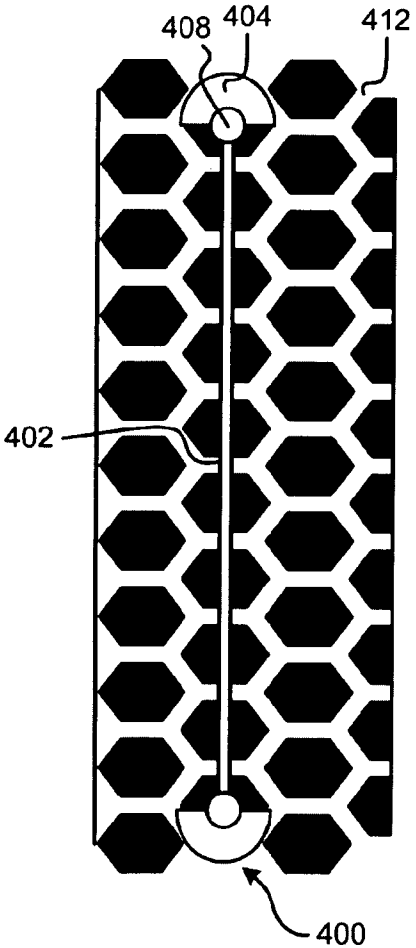
FIG. 4E is a schematic diagram of a front view of a tag coupled to an electronics system according to one embodiment.

Now referring to FIGS. 4E and 4F, the tag 400 is shown mounted to the surface 412. The tag 400 has straightened out after insertion into the holes according to one approach, but complete straightening out is not required. The tag 400 may still maintain some amount of flex even after being inserted into the holes of the surface 412 according to some embodiments. As can be seen, the grip flange 406 has protruded past the internal surface of the hole such that it can grip the interior surface in one approach. However, in other approaches, the grip flange 406 may remain in the hole, such that it grips the interior surfaces of the hole. Other approaches may include more or less flanges, different shapes of flanges, such as square, rectangular, cylindrical, triangular, etc. Also, the flanges may have different heights and widths, depending on the hole arrangement on the surface for which the tag 400 is to be mounted.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A tag, comprising:

a substantially flat portion having two faces facing away from one another and of about equal size, and a length and a height the faces being adapted for receiving a label, wherein the length is between about 1 inch and about 2 ½ inches, wherein the height is between about ⅜ inch and about 1 inch; and at least one first member coupled to the substantially flat portion and extending away therefrom at an angle of between about 45° and about 135° to a plane normal to a plane of the substantially flat portion, the at least one first member being adapted for mounting in an opening of a surface of an electronics system thereby creating a removable coupling between the at least one first member and the surface of an electronics system and an orientation of the faces of the substantially flat portion at an angle of between about 45° and about 135° to the surface of the electronic device when mounted wherein the substantially flat portion has a recessed section between the at least one member and a second member, the recess extending into peripheral edges of the faces of the substantially flat portion in a direction away from a plane of the surface of an electronics system.

2. A tag as recited in claim 1, further comprising at least one second member coupled to the substantially flat portion and extending away therefrom at an angle of between about 45° and about 135° to a plane of the substantially flat portion, wherein the at least one second member does not create a removable coupling when mounted between the at least one second member and the surface of an electronics system.

3. A tag as recited in claim 1, wherein the surface of an electronics system is a perforated or ventilated portion of a computer server enclosure.

4. A tag as recited in claim 3, wherein the surface of an electronics system is a perforated bezel of a blade server.

5. A tag as recited in claim 3, wherein the at least one first member when coupled to an opening of the surface of an electronics system does not block a portion of the opening of the surface of an electronics system, wherein the faces lie along parallel planes, wherein the at least one first member is adapted for mounting in an opening of a surface of an electronics system thereby creating an orientation of the faces of the substantially flat portion at an angle of about 90° to the surface of the electronic device.

6. A tag as recited in claim 1, wherein the length and height of the substantially flat portion are at least long enough to receive a standard 1⅞ inch by ⅝ inch adhesive label on at least one face of the substantially flat portion.

7. A tag as recited in claim 1, wherein the at least one first member comprises a compressible portion for effecting the removable coupling between the at least one first member and the surface of an electronics system.

8. A tag as recited in claim 7, wherein the at least one first member further comprises a spring post for effecting the removable coupling between the at least one first member and the surface of an electronics system.

9. A tag as recited in claim 7, wherein the at least one first member further comprises a bent wire or ribbon for effecting the removable coupling between the at least one first member and the surface of an electronics system.

10. A tag as recited in claim 1, wherein the tag is mountable to the surface of an electronics system without access to a rear side of the surface of an electronics system.

11. A tag as recited in claim 1, wherein the tag is removable from the surface of an electronics system without access to a rear side of the surface of an electronics system.

12. A tag as recited in claim 1, wherein the tag is mountable to the surface of an electronics system without use of any tools or hardware.

13. A tag as recited in claim 1, wherein the tag is removable from the surface of an electronics system without use of any tools or hardware.

14. A tag as recited in claim 1, wherein the at least one first member, when mounted in an opening of the surface of an electronics system, does not protrude substantially beyond a rear side of the surface of an electronics system.

15. A tag as recited in claim 1, wherein the at least one first member includes a magnetic portion for effecting the removable coupling between the at least one first member and the surface of an electronics system.

16. A tag, comprising:

a substantially flat portion having two faces facing away from one another and a length and a height, two members coupled to the substantially flat portion and extending away therefrom at an angle of between about 45° and about 135° to a plane normal to a plane of the substantially flat portion, wherein the angle from which the two members extend away from the substantially flat portion is adjustable, wherein the members are adapted for mounting in an opening of a perforated bezel of a blade server thereby creating a removable coupling between the members and the blade server when mounted, wherein the two members are positioned near either end of the substantially flat portion along the length, wherein the substantially flat portion has a recessed section between the two members, the recess extending into peripheral edges of the faces of the substantially flat portion in a direction away from a plane of the blade server, wherein the removable coupling is effected without access to a rear side of the perforated bezel of the blade server and without use of any tools or hardware, wherein the two members when coupled to an opening of the perforated bezel of the blade server do not block a portion of the opening of the perforated bezel of the blade server, wherein the adjustable angle of the two members allows user selection of an angle of orientation of the plane of the substantially flat portion relative to the surface of the blade server.

17. A tag, comprising:

a substantially flat portion having two faces facing away from each other, two members coupled to the substantially flat portion and extending away therefrom at an angle of between about 45° and about 135° to a plane normal to a plane of the substantially flat portion, the two members being adapted for mounting in an opening of a second surface thereby creating a removable coupling between the two members and the second surface and an orientation of the faces of the substantially flat portion at an angle of between about 45° and about 135° to the second surface when mounted, wherein the two members are positioned near either end of an edge of the substantially flat portion, wherein the substantially flat portion has a recessed section between the two members, the recess extending into peripheral edges of the faces of the substantially flat portion in a direction away from a plane of the second surface, wherein the removable coupling is effected without access to a rear side of the second surface and without use of any tools or hardware.

18. A tag as recited in claim 17, wherein the flat portion is flexible along the plane thereof for.

19. A tag as recited in claim 17, wherein the second surface is of an electronics system, wherein the two members each comprise a compressible portion for effecting the removable coupling between the at least one first member and the second surface of an electronics system, wherein at least one of the members includes a component selected from a group consisting of: a spring post for effecting the removable coupling between the at least one first member and the second surface of the electronics system; a bent wire for effecting the removable coupling between the at least one first member and the second surface of the electronics system; and a ribbon for effecting the removable coupling between the at least one first member and the second surface of the electronics system.

* * * * *